US008639148B2

(12) United States Patent
Kyung et al.

(10) Patent No.: US 8,639,148 B2
(45) Date of Patent: Jan. 28, 2014

(54) IMAGE FORMING APPARATUS AND CONTROL METHOD THEREOF

(75) Inventors: Myung Ho Kyung, Suwon-si (KR); Jeong Hwan Kim, Gunsan-si (KR); Myung Song Jung, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 351 days.

(21) Appl. No.: 12/858,636

(22) Filed: Aug. 18, 2010

(65) Prior Publication Data

US 2011/0052246 A1 Mar. 3, 2011

(30) Foreign Application Priority Data

Aug. 25, 2009 (KR) ..... 10-2009-0078476

(51) Int. Cl.
*G03G 21/20* (2006.01)

(52) U.S. Cl.
USPC ..... 399/92; 399/69

(58) Field of Classification Search
USPC ..... 399/69, 92, 94
See application file for complete search history.

(56) References Cited

U.S. PATENT DOCUMENTS 5,138,375 A * 8/1992 Iimori ..... 399/92
5,920,749 A * 7/1999 Sugaya et al. ..... 399/69

FOREIGN PATENT DOCUMENTS

JP 08-324068 12/1996
JP 2008-185926 8/2008

* cited by examiner

*Primary Examiner* — Ryan Walsh
(74) *Attorney, Agent, or Firm* — Stanzione & Kim, LLP

(57) ABSTRACT

An image forming apparatus which includes a fan to generate an air flow within the image forming apparatus, and a controller to drive the fan at a first speed corresponding to a first time period representing an image forming operation and to drive the fan at a second speed corresponding to a second time period corresponding to operations other than the image forming operation.

5 Claims, 12 Drawing Sheets

IMAGE FORMING APPARATUS AND CONTROL METHOD THEREOF

CROSS-REFERENCE TO RELATED APPLICATIONS

This application claims priority under 35 U.S.C. §119(a) from Korean Patent Application No. 2009-0078476, filed on Aug. 25, 2009 in the Korean Intellectual Property Office, the disclosure of which is incorporated herein in its entirety by reference.

BACKGROUND

1. Field of the Invention

Embodiments of the present general inventive concept relate to an image forming apparatus and a control method thereof to reduce and/or prevent interior contamination of the image forming apparatus due to scattering of waste developer.

2. Description of the Related Art

Generally, an image forming apparatus is designed to print a black-and-white image or a color image on a printing medium, such as paper. In an operation of the image forming apparatus, light is irradiated onto a photoconductor that is charged with a uniform electric potential, causing an electrostatic latent image to be formed on the photoconductor. After the electrostatic latent image is developed into a visible image of a predetermined color via a developing unit, the resulting visible image is then transferred and fused onto a sheet of paper.

To print a color image, the image forming apparatus usually uses yellow, magenta, cyan, and black developers. Therefore, the image forming apparatus may include four developing units to respectively develop the developers of four colors. In this case, color image forming methods are classified into a single-path method in which four exposure units and four photoconductors are provided, and a multi-path method in which a single exposure unit and a single photoconductor are provided.

As a type of the image forming apparatus, an electrophotographic image forming apparatus generally adopts an image forming method including a charge operation, an exposure operation, a developing operation, a transfer operation, and a fusing operation.

SUMMARY

Exemplary embodiments of the present general inventive concept provide an image forming apparatus and a control method thereof, in which scattering of waste developer may be minimized and/or prevented by controlling driving of a fan during a time except for an image forming time.

Additional features and/or utilities of the present general inventive concept will be set forth in part in the description which follows and, in part, will be obvious from the description, or may be learned by practice of the general inventive concept.

Exemplary embodiments of the present general inventive concept may provide an image forming apparatus which includes a fan to generate an air flow or stream within the image forming apparatus, and a controller to drive the fan at a first speed (i.e., a standard speed) corresponding to a first time period representing an image forming operation, and to drive the fan at a second speed (i.e., a speed less than the standard speed or stop the fan) corresponding to a second time period representing an operation other than the image forming operation.

The second speed may be less than the first speed. The second time period may include a time to perform compensation of color tone density of the image forming apparatus.

The second time period may include a time to perform compensation of auto color registration of the image forming apparatus.

The second time period may include a time to form a developer strip to extend a lifespan or an anti-flip function of a cleaning unit provided in the image forming apparatus.

The second time period may include a time to perform a mechanical cleaning operation when an initial power is supplied to the image forming apparatus.

The second time period may include a time to re-operate the image forming apparatus after the image forming apparatus performs a recovery operation due to jamming of a printing medium during an image forming operation thereof.

The image forming apparatus may further include a temperature sensor to measure an interior temperature of the image forming apparatus, and the controller may drive the fan at the second speed or stop the fan based on the interior temperature of the image forming apparatus.

The controller may drive the fan at the second speed when the interior temperature of the image forming apparatus is larger than a predetermined temperature.

The controller may stop the fan when the interior temperature of the image forming apparatus is less than a predetermined temperature.

The controller may drive the fan at the second speed or stop the fan by controlling a voltage or a current supplied to the fan.

Exemplary embodiments of the present general inventive concept may also provide a control method of an image forming apparatus which includes driving a fan at a first speed (i.e., a standard speed) during a first time period corresponding to an image forming operation, and driving the fan at a second speed less than the first speed or stopping the fan to prevent scattering of waste developer during a second time period corresponding to operations other than the image forming operation.

The second speed may be less than the first speed. The fan may be driven at the second speed or may be stopped as a voltage or a current supplied to the fan is controlled.

The second time period may include a time to perform compensation of color tone density of the image forming apparatus.

The second time period may include a time to perform compensation of auto color registration of the image forming apparatus.

The second time period may include a time to form a developer strip to extend a lifespan or an anti-flip function of a cleaning unit of the image forming apparatus.

The second time period may include a time to perform a mechanical cleaning operation when an initial power is supplied to the image forming apparatus.

The second time period may include a time to re-operate the image forming apparatus after the image forming apparatus performs a recovery operation due to jamming of a printing medium during an image forming operation thereof.

Exemplary embodiments of the present general inventive concept may also provide an image forming apparatus which includes an image forming unit to form an image, a fan unit to operate at first, second, and third speeds respectively corresponding to a first air flow force, a second air flow force, and a third air flow force, and a controller to drive the fan unit at the first speed during an image forming operation of the image forming unit and to drive the fan at the second or the third speed during operations other than the image forming operation, wherein the first air flow force is larger than the second and third airflow forces.

The image forming operation may include an operation to charge a surface of a photoconductor, an operation to form an electrostatic latent image on the photoconductor, an operation to develop a visible image, an operation to transfer the visible image, and an operation to fuse the visible image onto a printing medium.

The operations other than the image forming operation may include an operation to compensate for color tone density, an operation to compensate for auto color registration, an operation to extend a lifespan of a cleaning unit, and an operation to clean the image forming unit.

The second air flow force may be larger than the third airflow force.

The image forming apparatus may further include a temperature sensor to measure a temperature of the image forming apparatus, wherein the controller may drive the fan unit to operate at the second or the third speed according to the temperature of the image forming apparatus. The fan unit may be stopped at the third speed.

Exemplary embodiments of the present general inventive concept may also provide an image forming apparatus which includes a controller usable with an image forming apparatus having a fan unit and an image forming unit to form an image which includes a controller unit to drive the fan unit at a first speed during a first operation of the image forming apparatus and to drive the fan unit at a second speed different than the first speed during a second operation of the image forming apparatus, wherein the first speed of the fan unit corresponds to an air flow force which is larger than that of the second speed.

The first operation of the image forming apparatus may include an operation to charge a surface of a photoconductor, an operation to form an electrostatic latent image on the photoconductor, an operation to develop a visible image, an operation to transfer the visible image, and an operation to fuse the visible image onto a printing medium.

The second operation of the image forming apparatus may include an operation to compensate for color tone density, an operation to compensate for auto color registration, an operation to extend a lifespan of a cleaning unit, and an operation to clean the image forming unit.

Exemplary embodiments of the present general inventive concept may also provide a non-transitory computer-readable medium having embodied thereon computer-readable codes to execute a method to control a fan unit of an image forming apparatus having an image forming unit to form an image, the method includes driving the fan unit at a first fan speed during an image forming operation of the image forming unit and driving the fan unit at a second fan speed different than the first speed during operations other than the image forming operation of the image forming unit, wherein the first fan speed corresponds to a first airflow force which is larger than a second airflow force corresponding to the second fan speed.

BRIEF DESCRIPTION OF THE DRAWINGS

These and/or other features and utilities of the present general inventive concept will become apparent and more readily appreciated from the following description of the exemplary embodiments, taken in conjunction with the accompanying drawings of which.

DETAILED DESCRIPTION OF THE EMBODIMENTS

Figure 1:
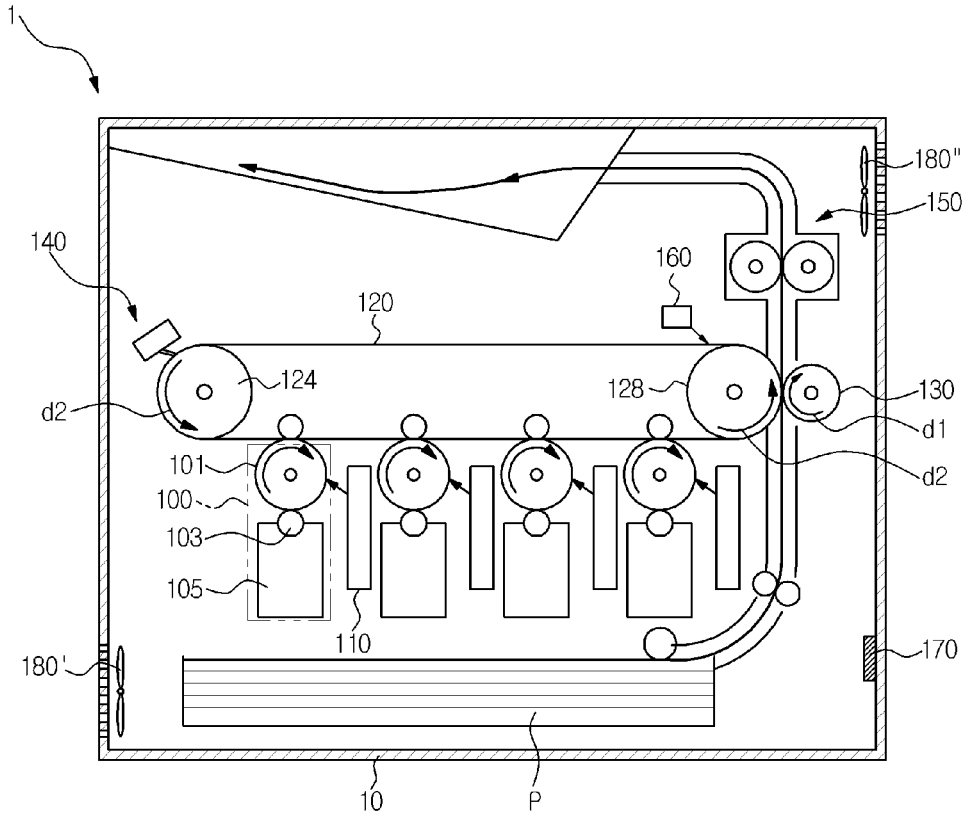
FIG. 1 is a configuration view schematically illustrating a single-path type image forming apparatus according to an exemplary embodiment of the present general inventive concept.

Reference will now be made in detail to exemplary embodiments of the present general inventive concept, examples of which are illustrated in the accompanying drawings, wherein like reference numerals refer to like elements throughout. The exemplary embodiments are described below in order to explain the present general inventive concept by referring to the figures.

FIG. 1 is a configuration view schematically illustrating a single-path type image forming apparatus according to an exemplary embodiment of the present general inventive concept.

As illustrated in FIG. 1, the image forming apparatus 1 according to an exemplary embodiment of the present general inventive concept includes a developing unit 100 in which developer, such as toner, is stored, an exposure unit 110 to form an electrostatic latent image on a photoconductor 101 provided in the developing unit 100, an intermediate transfer belt 120 to perform intermediate-transfer of the developer disposed on the photoconductor 101, a transfer roller 130 to transfer a visible image on the intermediate transfer belt 120 to a printing medium P, a cleaning unit 140 to remove waste developer that remains on an outer peripheral surface of the intermediate transfer belt 120 which was not transferred to the printing medium P, a fusing unit 150 to fuse the transferred image onto the printing medium P, an optical sensor 160 to check a quantity of light upon compensation of Color Tone Density (CTD) or Auto Color Registration (ACR) of the image forming apparatus 1, a temperature sensor 170 to measure an interior temperature of the image forming apparatus 1, and fans 180' and 180" to remove interior heat of a body 10 of the image forming apparatus 1.

The developing unit 100 includes the photoconductor 101, a developing roller 103 to supply the developer to the photoconductor 101, and a developer storage device 105 in which the developer can be stored.

In exemplary embodiments, the photoconductor 101 takes a form of a cylindrical metallic drum and has a photoconductive material layer coated over an outer peripheral surface thereof via a coating process, such as deposition. However, the present general inventive concept is not limited thereto. That is, the photoconductor material layer may be disposed on a surface of the photoconductor 101 by various other methods. The photoconductive material layer can react to light exposed by the exposure unit 110 to allow an electrostatic latent image corresponding to image data to be formed on the photoconductor 101. A charge roller (not illustrated) is provided at a side of the photoconductor 101 and may be used to charge the outer peripheral surface of the photoconductor 101 with a uniform electric potential. The charge roller (not illustrated) can be rotated while an outer peripheral surface thereof comes into contact with the photoconductor 101. In an exemplary embodiment, if a charge bias voltage is applied to the charge roller (not illustrated), the charge roller acts to charge a partial longitudinal region of the outer peripheral surface of the photoconductor 101 with the uniform electric potential.

After the outer peripheral surface of the photoconductor 101 is charged with the uniform electric potential, the exposure unit 110 irradiates a light beam onto the outer peripheral surface of the photoconductor 101. The resulting light irradiation region of the outer peripheral surface, to which the light beam is irradiated, and the remaining region of the outer peripheral surface, to which no light beam is irradiated, may have an electric potential difference. In exemplary embodiments, an electrostatic latent image is formed on the light irradiation region due to the electrical potential difference. Then, if the developer is supplied to the photoconductor 101, only the light irradiation region, to which the light beam is irradiated from the exposure unit 110, adsorbs the developer. Thereby, the electrostatic latent image can be developed into a visible image by the developer.

The developing roller 103 can serve to supply the developer, supplied from a feed roller (not illustrated), toward the electrostatic latent image of the photoconductor 101. A power source (not illustrated) supplies a developing voltage to the developing roller 103 in order to supply the developer to the photoconductor 101. Here, the developing voltage can be larger than a surface voltage that is imparted onto the surface of the photoconductor 101 by the charge voltage of the charge roller (not illustrated), and can be less than a surface voltage of the electrostatic latent image formed by the exposure unit 110. The developer on the surface of the developing roller 103 can be attached to the electrostatic latent image of the photoconductor 101 by the voltage difference between the developing roller 103 and the photoconductor 101.

The developer storage device 105 can be configured to receive the developer therein. The developer storage device 105 may also contain, e.g., a feed roller (not illustrated) to supply the developer to the developing roller 103, and an agitator (not illustrated) to agitate the developer.

Here, the developing unit 100 is provided for each color. That is, in exemplary embodiments, there are a total of four developing units 100 for the four colors yellow Y, magenta M, cyan C, and black K. However, the present general inventive concept is not limited thereto.

The exposure unit 110 irradiates light onto the photoconductor 101 based on printing data to form the electrostatic latent image thereon. The electrostatic latent image formed by the exposure unit 110 consists of a predetermined size of spots based on a magnitude of a light source. In this case, the size of printing dots, to which the developer is applied, is determined by a light irradiation time from the exposure unit 110 to the photoconductor 101.

Different colors of images formed by the developing units 110 sequentially overlap one another on the intermediate transfer belt 120 to form a predetermined visible image. Then, the visible image is transferred to the printing medium P by passing through a gap G between the transfer roller 130 and the intermediate transfer belt 120. Driving rollers 124 and 128 are installed within an inner peripheral surface of the intermediate transfer belt 120 (see FIG. 3A). The driving rollers 124 and 128 serve to rotate the intermediate transfer belt 120.

The transfer roller 130 extends in a longitudinal direction of the intermediate transfer belt 120. The transfer roller 130 forces the printing medium P toward the intermediate transfer belt 120 to allow the visible image formed on the intermediate transfer belt 120 to be transferred to the printing medium P. The transfer roller 130 faces the driving roller 128 with the intermediate transfer belt 120 interposed therebetween, and can be rotated in an opposite direction d1 of a rotating direction d2 of the driving rollers 124 and 128.

In exemplary embodiments, the cleaning unit 140 takes a form of a blade which extends in a longitudinal direction of the intermediate transfer belt 120. One side of the cleaning unit 140 comes into contact with the outer peripheral surface of the intermediate transfer belt 120, to remove the waste developer that remains on the surface of the intermediate transfer belt 120 which was not transferred to the printing medium P. The removed waste developer is directed in a direction (i.e., upward) away from the cleaning unit 140 by a rotating force of the intermediate transfer belt 120, and can be collected and stored in a predetermined waste developer storage space (not illustrated).

The fusing unit 150 serves to fuse the transferred image onto the printing medium P by applying heat and/or pressure to the printing medium P.

The optical sensor 160 is adapted to receive light reflected from density patches formed on the intermediate transfer belt 120 upon compensation of color tone density, and to receive light reflected from color pattern patches formed at the intermediate transfer belt 120 upon compensation of auto color registration.

The temperature sensor 170 serves to measure an interior temperature of the image forming apparatus 1 and to transmit a signal to a controller 240 that will be described hereinafter. The fans 180' and 180" serve to remove heat generated in the image forming apparatus 1.

Figure 2:
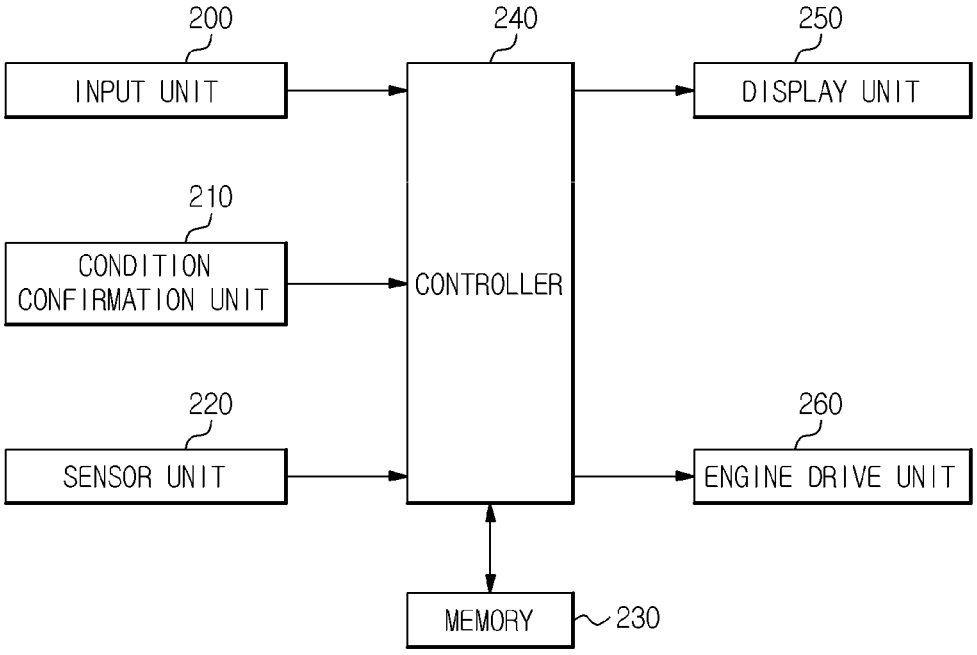
FIG. 2 is a control block diagram of an image forming apparatus according to an exemplary embodiment of the present general inventive concept.

FIG. 2 is a control block diagram of an image forming apparatus according to an exemplary embodiment of the present general inventive concept.

As illustrated in FIG. 2, the image forming apparatus 1 includes an input unit 200 including a plurality of input keys, a condition confirmation unit 210 to confirm an operating condition of the image forming apparatus 1, a sensor unit 220 to measure, e.g., an interior temperature of the image forming apparatus 1 or a quantity of light transferred to the intermediate transfer belt 120, a memory 230 in which data related to operating programs can be stored, a controller 240 to control an operation of the image forming apparatus 1, a display unit 250 to display the condition of the image forming apparatus 1 to outside of the image forming apparatus 1, and an engine drive unit 260 to perform a printing operation based on printing data stored in the memory 230.

The input unit 200 includes the plurality of input keys to allow a user to set a printing operation of the image forming apparatus 1. In an exemplary embodiment, if the user pushes a menu key (not illustrated) provided at the input unit 200, the display unit 250 displays a menu to set a number of pages on a per sheet basis. As the user selects the number of pages to be printed by pushing arrow keys (not illustrated) and pushes a print start button (not illustrated), the image forming apparatus 1 may perform a printing operation on printing media P based on the set number of pages.

The condition confirmation unit 210 confirms various conditions of the image forming apparatus 1, such as, e.g., whether or not the image forming apparatus 1 may form a toner image, or whether or not a separate compensation operation may be necessary to maintain a normal or desired print quality.

The sensor unit 220 includes the optical sensor 160 to receive light reflected from the density patches or the color pattern patches formed at the intermediate transfer belt 120 upon compensation of color tone density or auto color registration, and the temperature sensor 170 to measure an interior temperature of the image forming apparatus 1.

The memory 230 includes a non-volatile memory, such as Read Only Memory (ROM), in which a variety of programs to realize functions of the image forming apparatus 1 may be stored, and a volatile memory, such as Random Access Memory (RAM), in which data produced during implementation of programs by the controller 240 may be temporarily stored.

The controller 240 rotates the fans 180' and 180" at a standard speed (i.e., a first speed) for an image forming time required to form an image on the printing medium P (i.e., a first time period), to cool the interior of the image forming apparatus 1. That is, in exemplary embodiments, the controller 240 controls the fans 180' and 180" to rotate at the first speed during a time period required to form an image on the printing medium P. Also, the controller 240 rotates the fans 180' and 180" at a second speed which may be less than the standard speed or stops the fans 180' and 180" for a time except for the image forming time (i.e., a second time period) to prevent scattering of the waste developer. That is, in exemplary embodiments, the controller 240 controls the fans 180' and 180" to rotate at the second speed which is less than the first speed during time periods other than the time period required to form an image on the printing medium P. Here, the standard speed denotes a fan drive speed required to create a flow of an air stream within the image forming apparatus 1 when an image is formed on the printing medium P. The standard speed may be set arbitrarily by the user.

The image forming time denotes a time required to perform a series of charge-exposure-developing-transfer-fusing operations in order to form an image on the printing medium P. That is, the image forming time required to form an image on the printing medium P includes a charge time to charge an outer peripheral surface of the photoconductor 101 with a uniform electric potential, an exposure time to form the electrostatic latent image by irradiating the light beam to the charged photoconductor 101, a developing time to develop the visible image by supplying the developer to the photoconductor 101 on which the electrostatic latent image is formed, a first transfer time to primarily transfer the visible image formed on the photoconductor 101 to the intermediate transfer belt 120, a second transfer time to secondarily transfer the visible image from the intermediate transfer belt 120 to the printing medium P, and a fusing time to fuse the visible image onto the printing medium P by applying heat and/or pressure to the printing medium P.

The time period except for the image forming time denotes a time required to perform other operations besides the above mentioned operations to form an image on the printing medium P. In an exemplary embodiment, the time period except for the image forming time includes a time to perform compensation of color tone density, a time to perform compensation of auto color registration, a time to form a toner strip to extend a lifespan and an anti-flip function of the cleaning unit 140, and a time to perform a mechanical cleaning operation based on implementation of a recovery operation of the image forming apparatus 1.

Hereinafter, a principle to minimize and/or prevent scattering of the waste developer as the controller 240 reduces a rotating speed of the fans 180' and 180" or stops the fans 180' and 180" during the second time period which correspond to operations other than an image forming operation will be described with reference to the above-description.

The image forming apparatus 1 automatically or manually performs compensation of color tone density to compensate for a developing density. The compensation of color tone density is an operation to form the density patches at the intermediate transfer belt 120, to sense a density level via detection of light reflected from the density patches, and to compensate for a developing density based on the sensed density level. The density patches formed at the intermediate transfer belt 120 for compensation of color tone density are removed by the cleaning unit 140 rather than being transferred to the printing medium. In this case, although the density patches are primarily transferred to the intermediate transfer belt 120 for compensation of color tone density, the density patches do not undergo a secondary transfer operation for the transfer thereof to the printing medium P. This may generate waste developer of a standard amount or more, and may cause a large quantity of waste developer to be scattered and dispersed in the image forming apparatus 1 during a mechanical cleaning operation. Accordingly, reducing a rotating speed of the fans 180' and 180" or stopping the fans 180' and 180" when the density patches used for compensation of color tone density are removed by the mechanical cleaning operation may restrict the flow of an air stream within the image forming apparatus 1, so that scattering and dispersion of the density patches is minimized or prevented.

In addition, the image forming apparatus 1 automatically or manually performs compensation of auto color registration to detect a deviation of printing positions of different colors, such as yellow Y, magenta M, cyan C, and black K and to regulate the printing positions so as to coincide with one another. The compensation of auto color registration is an operation to form even patterns at the intermediate transfer belt 120 on a per color basis, to sense a deviation of printing positions via detection of the quantity of light reflected from the patterns, and to regulate the printing positions of different colors based on the sensed printing position deviation. The color pattern patches formed at the intermediate transfer belt 120 for compensation of auto color registration are removed by the cleaning unit 140 rather than being transferred to the printing medium. In this case, although the color pattern patches are primarily transferred to the intermediate transfer belt 120 for compensation of auto color registration, the color pattern patches do not undergo a secondary transfer operation for the transfer thereof to the printing medium P. This may generate waste developer of a standard amount or more, and may cause a large quantity of waste developer to be scattered and dispersed in the image forming apparatus during a mechanical cleaning operation. Accordingly, reducing a rotating speed of the fans 180' and 180" or stopping the fans 180' and 180" when the color pattern patches used for compensation of auto color registration are removed by the mechanical cleaning operation may restrict the flow of an air stream within the image forming apparatus 1, so that scattering and dispersion of the color pattern patches may be minimized or prevented.

In exemplary embodiments, the image forming apparatus 1 can be adapted to periodically form a developer strip serving as a lubricant at the cleaning unit 140 to extend a lifespan or an anti-flip function of the cleaning unit 140. To form the developer strip at the cleaning unit 140, an even pattern of the developer strip may be transferred to the intermediate transfer belt 120 and then, the transferred developer strip may be applied to the blade-shaped cleaning unit 140. Even or uniform pattern patches are formed at the intermediate transfer belt 120 so as to be used to form the developer strip at the cleaning unit 140 or be removed, rather than being transferred to the printing medium P. In this case, although the even pattern patches are primarily transferred to the intermediate transfer belt 120 for formation of the developer strip at the cleaning unit 140, the even pattern patches do not undergo a secondary transfer operation for the transfer thereof to the printing medium P. This may generate waste developer of a standard amount or more, and this may cause a large quantity of waste developer to be scattered and dispersed in the image forming apparatus during the mechanical cleaning operation. Accordingly, reducing a rotating speed of the fans 180' and 180" or stopping the fans 180' and 180" when the even pattern patches which are primarily transferred to the intermediate transfer belt 120 are removed by the mechanical cleaning operation may restrict the flow of an air stream within the image forming apparatus 1, so that scattering and dispersion of the patches may be minimized and/or prevented.

The cleaning unit 140 of the image forming apparatus 1 performs the mechanical cleaning operation to clean, e.g., the intermediate transfer belt 120 when initial power is supplied to the image forming apparatus 1. In this case, when a power is re-applied after the initial power is cut off during a printing operation of the image forming apparatus 1, or when a recovery operation is initiated after the printing operation is stopped due to jamming of the printing medium, waste developer of a standard amount or more may be present on the intermediate transfer belt 120 rather than being transferred to the printing medium. Therefore, when the initial power is supplied to the image forming apparatus 1 or when the image forming apparatus 1 is operated after the recovery operation, the controller 240 reduces a rotating speed of the fans 180' and 180" or stops the fans 180' and 180" at a time when the cleaning unit 140 performs the mechanical cleaning operation, thereby restricting the flow of an air stream within the image forming apparatus 1.

The controller 240, as described in the above exemplary embodiment, functions to prevent scattering of the waste developer by determining a time period in which the waste developer of a standard amount or more occurs and controlling the fans 180' and 180". Here, the waste developer denotes a part of the developer transferred to the intermediate transfer belt 120, which is not transferred to the printing medium P and thus, may be removed by the cleaning unit 140. Also, the standard amount denotes a quantity of developer corresponding to the part of developer which is not transferred to the printing medium P and thus, may be removed by the cleaning unit 140 although it was primarily transferred to the intermediate transfer belt 120. Accordingly, the standard amount of waste developer may be experimentally set by the user. However, the present general inventive concept is not limited thereto.

The controller 240 drives the fans 180' and 180" at a speed less than the standard speed (i.e., the first speed), or stops the fans 180' and 180" by controlling a voltage or current supplied to the fans 180' and 180" at the occurrence time during which the waste developer of a standard amount or more is generated. If the controller 240 cuts off the voltage or current applied to the fans 180' and 180" to stop the fans 180' and 180", the fans 180' and 180" gradually reduce speed and are finally stopped due to inertia. In this way, the controller 240 may reverse a rotating direction of the fans 180' and 180" by changing a polarity of an input power in order to rapidly stop the fans 180' and 180" and may also cut off the input power when the fans 180' and 180" are stopped.

The display unit 250 displays the condition of the image forming apparatus 1 to outside of the image forming apparatus 1. That is, in exemplary embodiments, if an error occurs in the image forming apparatus 1, the display unit 250 displays an error condition to the outside, to allow the user to view and correct the error. The display unit 250 displays a printing condition when the image forming apparatus 1 is performing a printing operation. Also, when the image forming apparatus 1 is performing a separate compensation operation, e.g., compensation of color tone density or auto color registration, the display unit 250 displays a separate compensation operation condition to the outside.

The engine drive unit 260 can be adapted to receive bit-map data output from the controller 240 and to convert the data into control signals based on characteristics of the image forming apparatus 1, so as to apply the control signals to an engine. In exemplary embodiments, the engine may include mechanical elements, such as, e.g., various motors and actuators provided in the image forming apparatus 1.

Figure 3A:
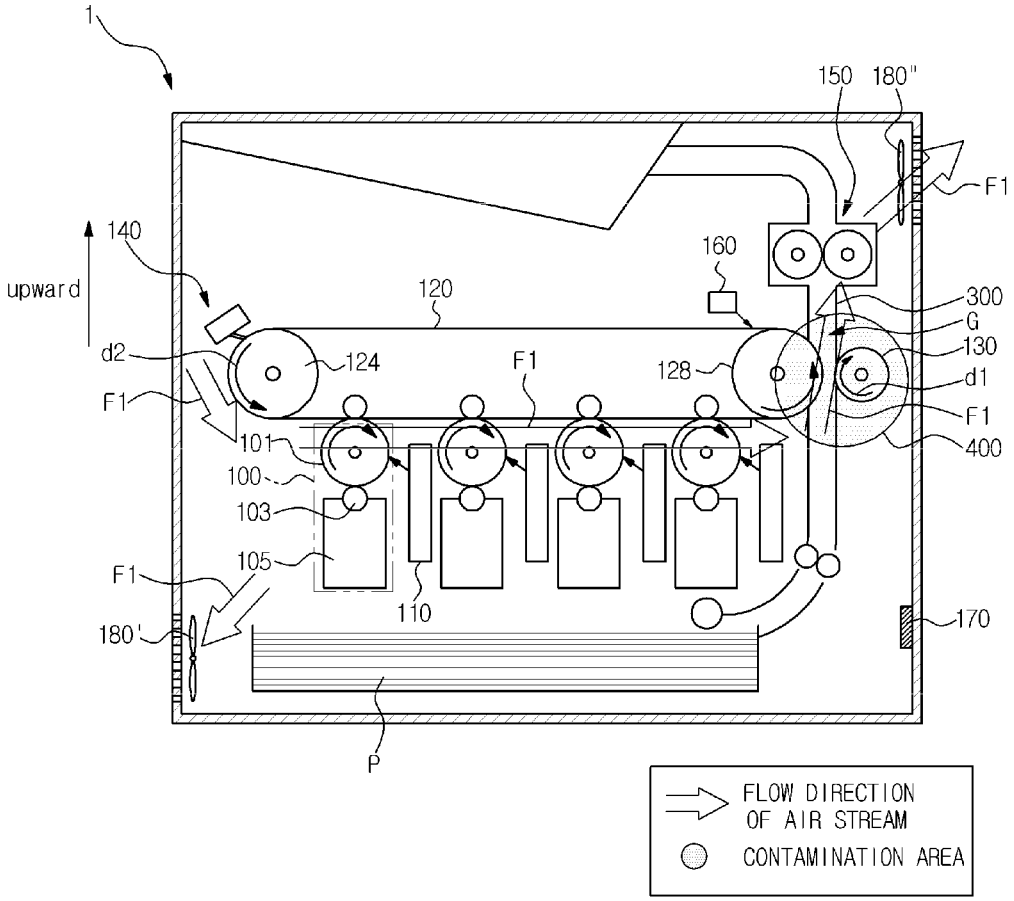
FIG. 3A is a view illustrating a flow path of an air stream within an image forming apparatus according to an exemplary embodiment of the present general inventive concept.
Figure 3B:
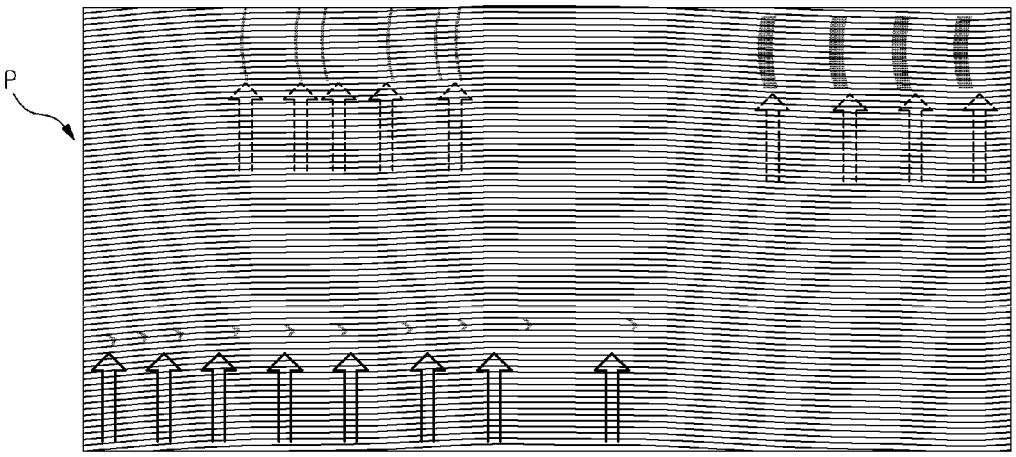
FIG. 3B is a view illustrating a condition of printing media output from an image forming apparatus according to an exemplary embodiment of the present general inventive concept.

FIG. 3A is a view illustrating a flow path $F_1$ of an air stream within the image forming apparatus 1 according to an exemplary embodiment of the present general inventive concept, and FIG. 3B is a view illustrating a condition of printing media output from the image forming apparatus according to an exemplary embodiment of the present general inventive concept.

FIG. 3A illustrates the flow path $F_1$ of an air stream and a contamination area 400 within the image forming apparatus 1 when the fans 180' and 180" are driven for a time period except for when the image is formed, e.g., for a time to compensate for color tone density. During the time period except for when the image is formed, the driving roller 128 of the intermediate transfer belt 120 can be spaced apart from the transfer roller 130 and an air stream may flow through a gap G between the driving roller 128 and the transfer roller 130. Thereby, waste developer scattered from the cleaning unit 140 moves into the gap G between the driving roller 128 of the intermediate transfer belt 120 and the transfer roller 130 by following the flow path $F_1$ of the air stream, to cause contamination of a printing medium moving section 300.

FIG. 3B illustrates an example of a rear end of the image forming apparatus 1 where numerous sheets of printing media output from the contaminated image forming apparatus 1 of FIG. 3A are piled up. As illustrated in FIG. 3B, the arrows point to contaminated portions of the output printing media.

Figure 4A:
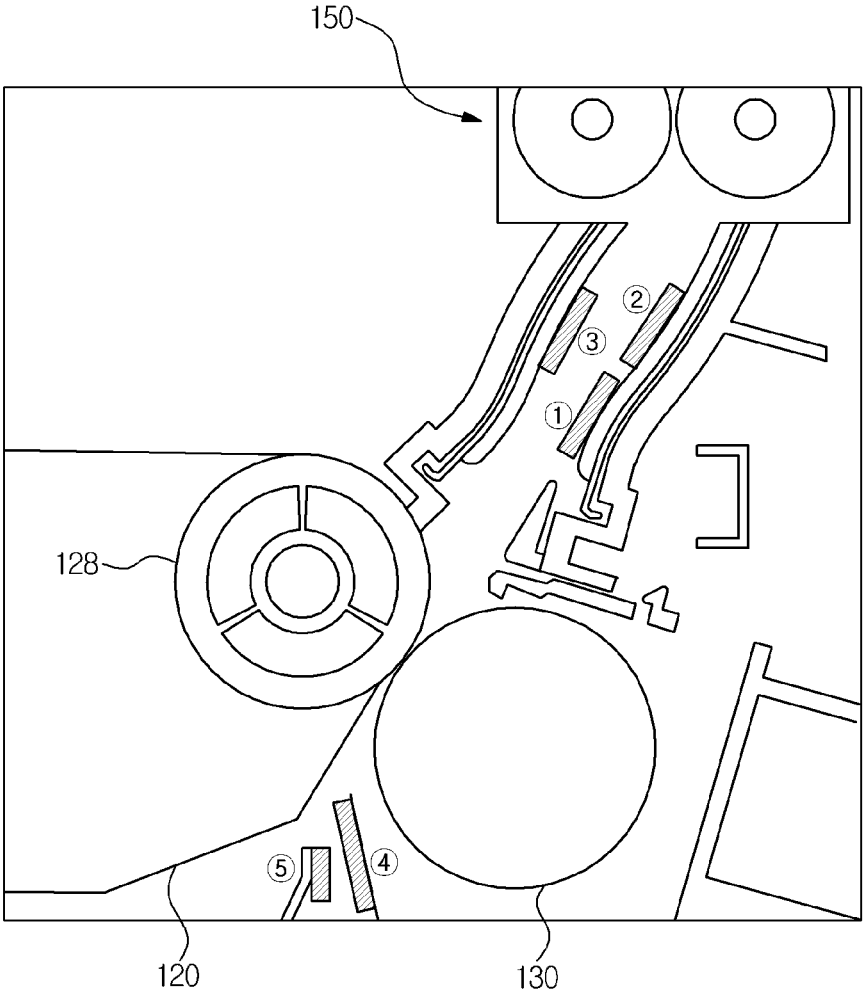
FIG. 4A is a view illustrating an interior contamination area of an image forming apparatus according to an exemplary embodiment of the present general inventive concept.
Figure 4B:
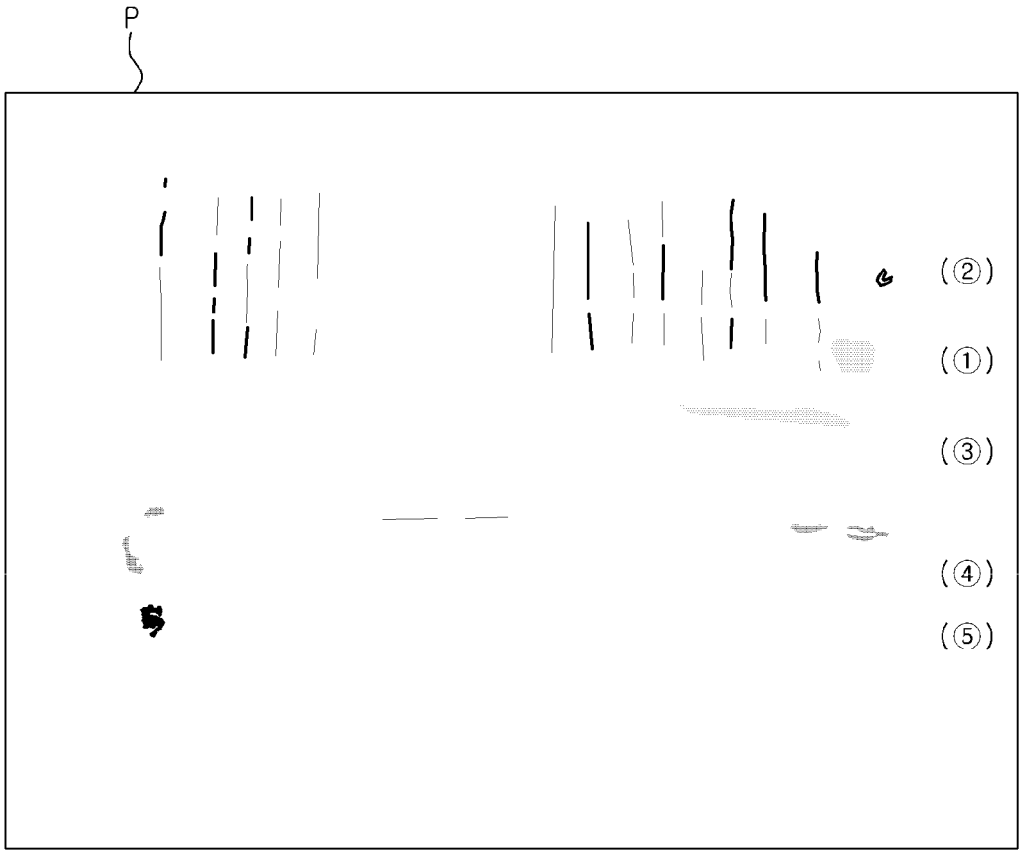
FIG. 4B is a view illustrating a condition of a printing medium output from an image forming apparatus according to an exemplary embodiment of the present general inventive concept.

FIG. 4A is a view illustrating an interior contamination area of the image forming apparatus 1 according to an exemplary embodiment of the present general inventive concept, and FIG. 4B is a view illustrating a condition of a printing medium output from the image forming apparatus 1 according to an exemplary embodiment of the present general inventive concept.

FIG. 4A illustrates the contamination area 400 illustrated in FIG. 3A in more detail. When the fans 180' and 180" are driven for the time except for the image forming time, the waste developer scattered from the cleaning unit 140 is dispersed into the printing medium moving section 300 by the air stream moving within the image forming apparatus 1, causing contamination of several positions within the image forming apparatus 1, indicated by the following labels ①, ②, ③, ④, and ⑤.

FIG. 4B illustrates a single sheet of printing medium having passed through the contamination area 400 of FIG. 4A. Specifically, FIG. 4B illustrates the contaminated state of the output printing medium P that comes into contact with the contaminated positions ①, ②, ③, ④, and ⑤ of FIG. 4A.

Figure 5A:
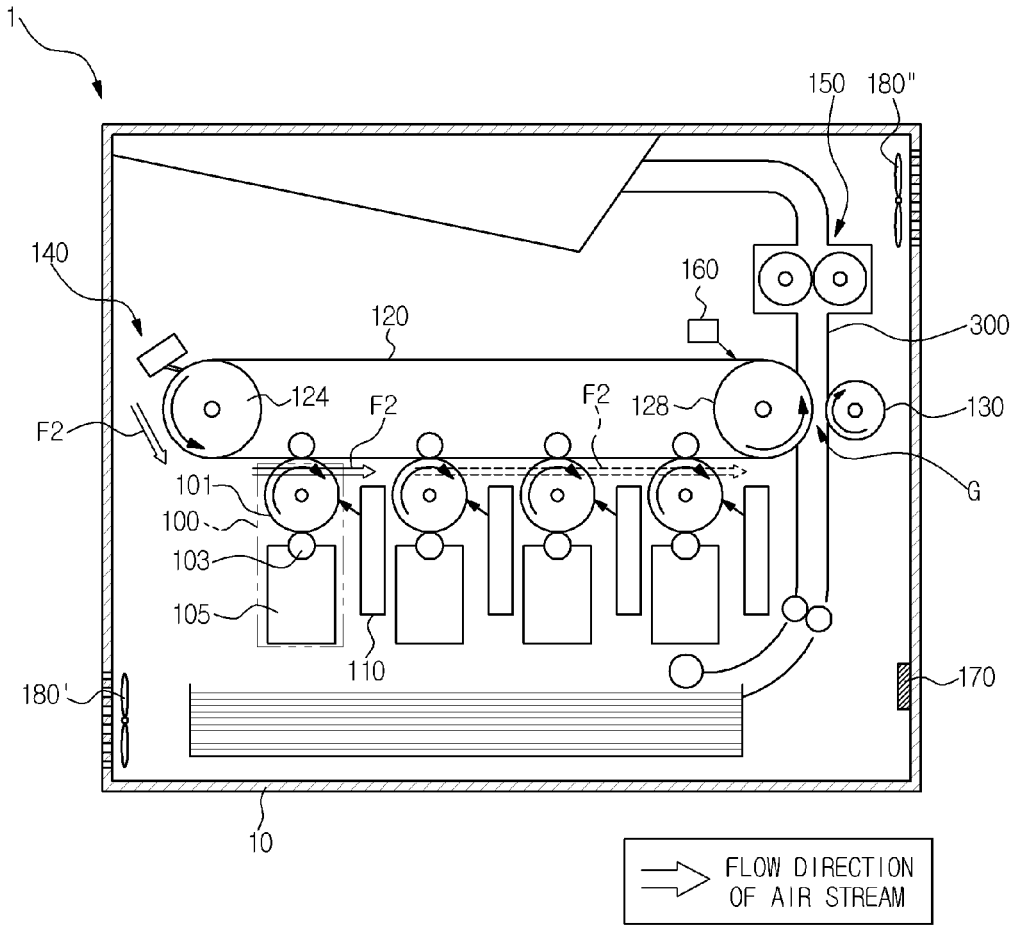
FIG. 5A is a view illustrating a flow path of an air stream within an image forming apparatus according to an exemplary embodiment of the present general inventive concept.
Figure 5B:
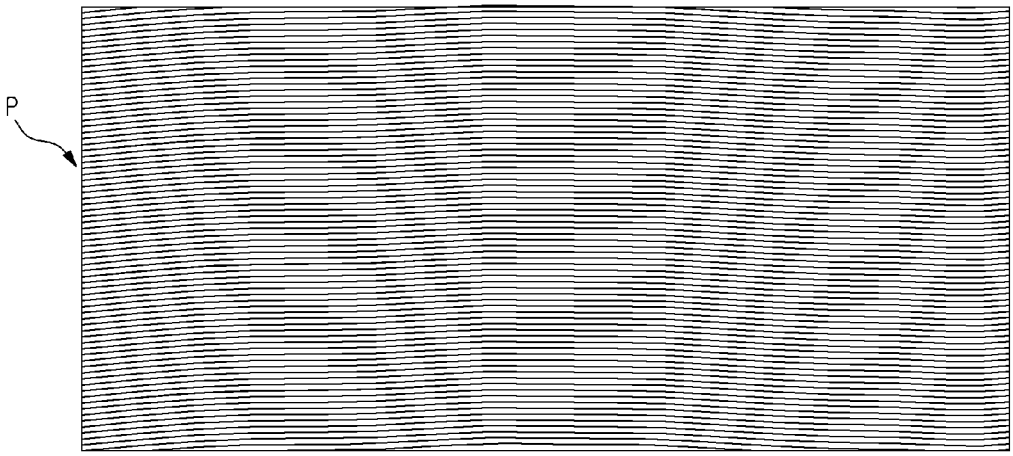
FIG. 5B is a view illustrating a condition of printed media output from an image forming apparatus according to an exemplary embodiment of the present general inventive concept.

FIG. 5A is a view illustrating a flow path $F_2$ of an air stream within the image forming apparatus 1 according to an exemplary embodiment of the present general inventive concept, and FIG. 5B is a view illustrating the condition of printing media output from the image forming apparatus 1 according to an exemplary embodiment of the present general inventive concept.

FIG. 5A illustrates the flow path $F_2$ of an air stream within the image forming apparatus 1 when the fans 180' and 180" are stopped for the time period except for when the image is formed, e.g., for the time to compensate for color tone density. During the time period except for when the image is formed, the driving roller 128 of the intermediate transfer belt 120 may be spaced apart from the transfer roller 130 and an air stream may flow through a gap G between the driving roller 128 and the transfer roller 130. However, since only a relatively small air stream is created in the image forming apparatus 1 by a rotation of each structure, e.g., the photoconductor 101 or the intermediate transfer belt 120, a substantially reduced quantity of waste developer is scattered from the cleaning unit 140 and is dispersed into the printing medium moving section 300.

FIG. 5B illustrates an example of a rear end of the image forming apparatus 1 where numerous sheets of printing media output from the contaminated image forming apparatus 1 of FIG. 5A are piled up. As illustrated in FIG. 5B, the printing media output from the image forming apparatus 1 are improved as compared to the outputted printing media illustrated in FIG. 3B and have no arrows that designate contaminated positions, as in FIG. 3B.

Figure 6:
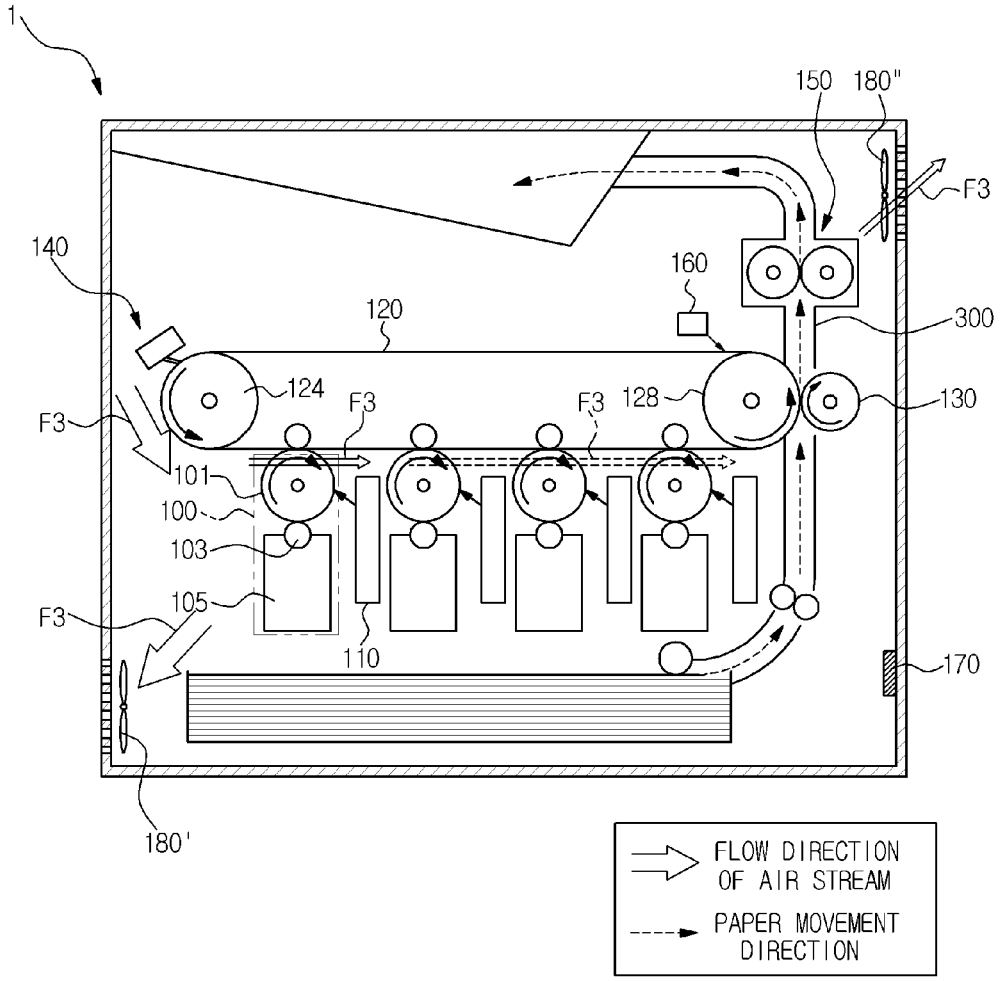
FIG. 6 is a view illustrating a flow path of an air stream within an image forming apparatus according to an exemplary embodiment of the present general inventive concept.

FIG. 6 is a view illustrating a flow path of an air stream within the image forming apparatus 1 according to an exemplary embodiment of the present general inventive concept.

FIG. 6 illustrates a flow path $F_3$ of an air stream in the image forming apparatus 1 when the fans 180' and 180" are driven for the time of performing a series of charge-exposure-developing-transfer-fusing operations to form an image on the printing medium. In an exemplary embodiment, the driving roller 128 of the intermediate transfer roller 120 is moved toward the transfer roller 130 during the image forming time and thus, substantially no air stream moves into the printing medium moving section 300. Accordingly, only a small quantity of waste developer is scattered from the cleaning unit 140 and is dispersed into the printing medium moving section 300. Also, as a visible image, which is primarily transferred to the intermediate transfer belt 120, is secondarily transferred to the printing medium P during the image forming time, only a small quantity of waste developer is scattered in the image forming apparatus 1.

Figure 7:
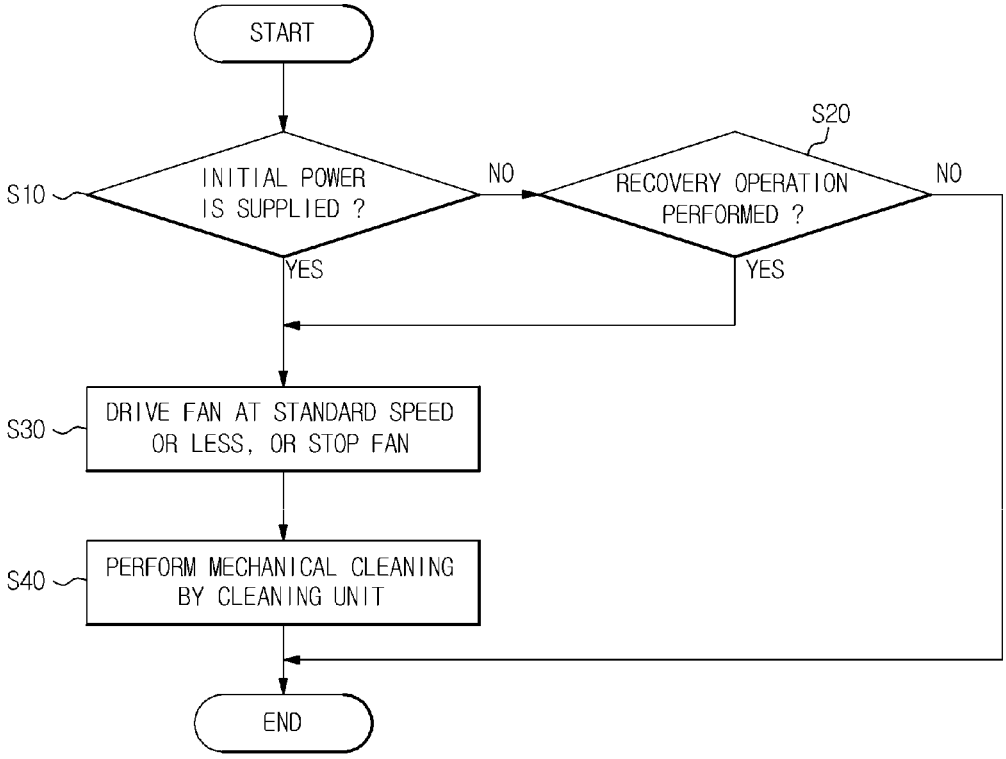
FIG. 7 is a control block diagram of an image forming apparatus according to an exemplary embodiment of the present general inventive concept.

FIG. 7 is a control block diagram of an image forming apparatus 1 according to an exemplary embodiment of the present general inventive concept.

As illustrated in FIG. 7, a condition confirmation unit 210 confirms whether or not an initial power is supplied to the image forming apparatus 1 (S10).

When the initial power is supplied, the cleaning unit 140 of the image forming apparatus 1 performs a mechanical cleaning operation. In addition, when power is supplied to the image forming apparatus 1 after the initial power is suddenly cut off during the image forming time (i.e., or a printing time), the cleaning unit 140 performs the mechanical cleaning operation to remove waste developer remaining on the intermediate transfer belt 120 rather than allowing the waste developer to be transferred to the printing medium P.

If it is confirmed that the initial power is supplied to the image forming apparatus 1, the fans 180' and 180" are driven at a standard speed, a speed less than the standard speed, or are stopped. Also, if it is confirmed that an interior temperature of the image forming apparatus 1 is less than a predetermined value, the fans 180' and 180" may be stopped. If the interior temperature of the image forming apparatus 1 is larger than the predetermined value, it may be important to cool a certain structure (motor, actuator, or the like) of the image forming apparatus 1 although preventing scattering of waste developer is important. Therefore, if it is confirmed that the interior temperature of the image forming apparatus 1 is larger than the predetermined value, the fans 180' and 180" are driven at a standard speed or less, serving not only to prevent scattering of waste developer, but also to cool the structure (S30).

Next, the controller 240 controls, e.g., the cleaning unit 140, causing the cleaning unit 140 to perform the mechanical cleaning operation of the corresponding structure (e.g., the photoconductor, or the intermediate transfer belt). Although FIG. 1 illustrates the cleaning unit 140 to remove waste developer on the intermediate transfer belt 120, in exemplary embodiments, a plurality of cleaning units may be provided to clean other structures including the photoconductor, etc. (S40).

The condition confirmation unit 210 confirms whether or not the recovery operation is performed after it is confirmed that the initial power is supplied to the image forming apparatus 1. The recovery operation denotes an operation to resolve or remove any abnormal operation when an image forming operation is stopped due to the abnormal operation. For example, if jamming of the printing medium P occurs, the recovery operation is implemented to remove the jammed printing medium P. Once the image forming apparatus 1 performs the recovery operation, there remains a large quantity of waste developer not transferred to the printing medium (S20).

Next, if it is confirmed that the image forming apparatus 1 performs the recovery operation, the fans 180' and 180" are driven at a standard speed or less, or are stopped. When the image forming apparatus 1 initiates the recovery operation during a printing operation thereof, the interior temperature of the image forming apparatus 1 may be a predetermined temperature or more, or may be less than the predetermined temperature. If it is confirmed that the interior temperature of the image forming apparatus 1 is the predetermined temperature or more, the fans 180' and 180" are driven at a standard speed or less, performing anti-scattering of waste developer as well as cooling of the structure. Then, if it is confirmed that the interior temperature of the image forming apparatus 1 is less than the predetermined temperature, the fans 180' and 180" are stopped, thereby preventing a scattering of waste developer (S30).

Next, the controller 240 controls the cleaning unit 140, causing the cleaning unit 140 to perform the mechanical cleaning operation on the intermediate transfer belt 120. In this case, another cleaning unit (not illustrated) installed to another structure (e.g., the photoconductor) may simultaneously perform a cleaning operation on the corresponding structure (S40).

Figure 8:
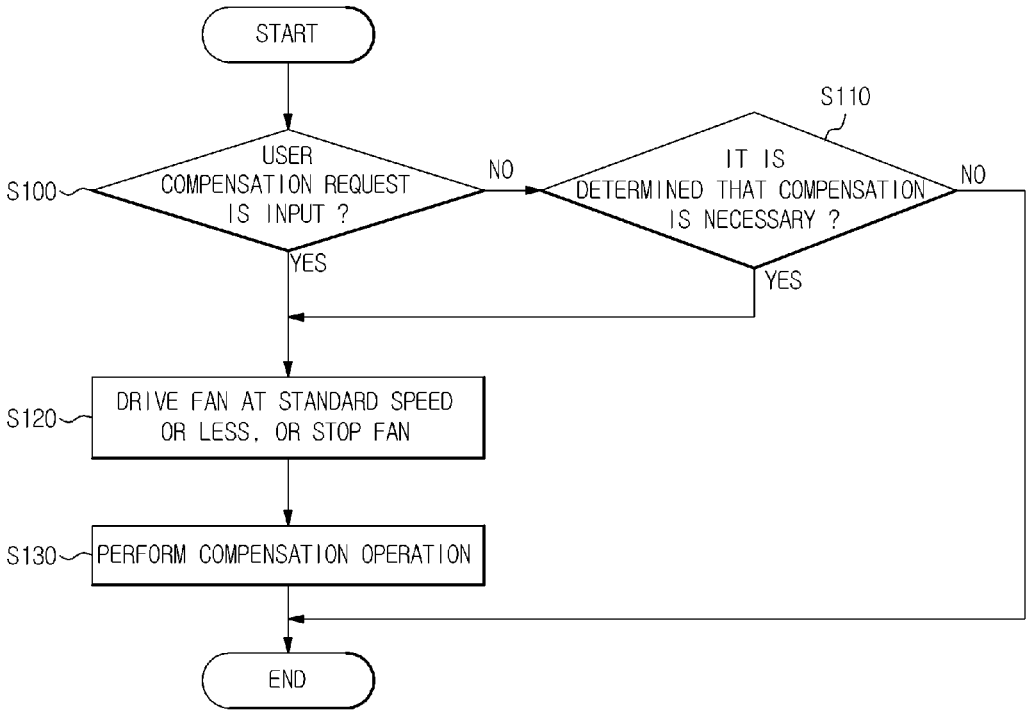
FIG. 8 is a control block diagram of an image forming apparatus according to an exemplary embodiment of the present general inventive concept.

FIG. 8 is a control block diagram of an image forming apparatus 1 according to an exemplary embodiment of the present general inventive concept.

As illustrated in FIG. 8, the controller 240 confirms whether or not the user requests compensation of the image forming apparatus 1 via the input unit 200 (S100). Here, compensation includes compensation of color tone density or auto color registration. The compensation of color tone density includes forming density patches at the intermediate transfer belt 120, sensing a density level by receiving light reflected from the density patches, and compensating for a developing density based on the sensed density level. The density patches, which are formed at the intermediate transfer belt 120 for compensation of color tone density, are removed by the cleaning unit 140 rather than being transferred to the printing medium P. Also, the compensation of auto color registration includes forming color pattern patches on a per color basis at the intermediate transfer belt 120, sensing a deviation of printing positions by sensing a quantity of light reflected from the patterns on a per color basis, and regulating the printing positions of different colors. The color pattern patches, which are formed at the intermediate transfer belt 120 for compensation of auto color registration, are removed by the cleaning unit 140 rather than being transferred to the printing medium (S100).

Next, if it is confirmed that the user compensation request is input, the controller 240 drives the fans 180' and 180" at a standard speed or less, or stops the fans 180' and 180" (S120). Specifically, the fans 180' and 180" are driven at a standard speed or less when the interior temperature of the image forming apparatus is larger than the predetermined temperature, or are stopped when the interior temperature of the image forming apparatus 1 is less than the predetermined temperature (S120).

Next, the controller 240 performs an operation requested by the user, e.g., compensation of color tone density or auto color registration (S130).

On the other hand, if it is confirmed that the user compensation request is not input, the condition confirmation unit 210 confirms whether or not compensation of the image forming apparatus 1 is necessary (S110). The image forming apparatus 1 is designed to periodically or non-periodically perform a compensation operation. In an exemplary embodiment, the image forming apparatus 1 may perform a compensation operation per predetermined interval, or whenever images are formed on a predetermined number of printing media (S120).

Next, if it is confirmed that the image forming apparatus 1 requires a compensation operation, the controller 240 drives the fans 180' and 180" at a standard speed or less, or stops the fans 180' and 180". Specifically, the fans 180' and 180" are driven at a standard speed or less when the interior temperature of the image forming apparatus is larger than the predetermined temperature, or are stopped when an interior temperature of the image forming apparatus 1 is less than the predetermined temperature (S120).

Next, the controller 240 performs a necessary compensation operation of the image forming apparatus 1 (S130).

Figure 9:
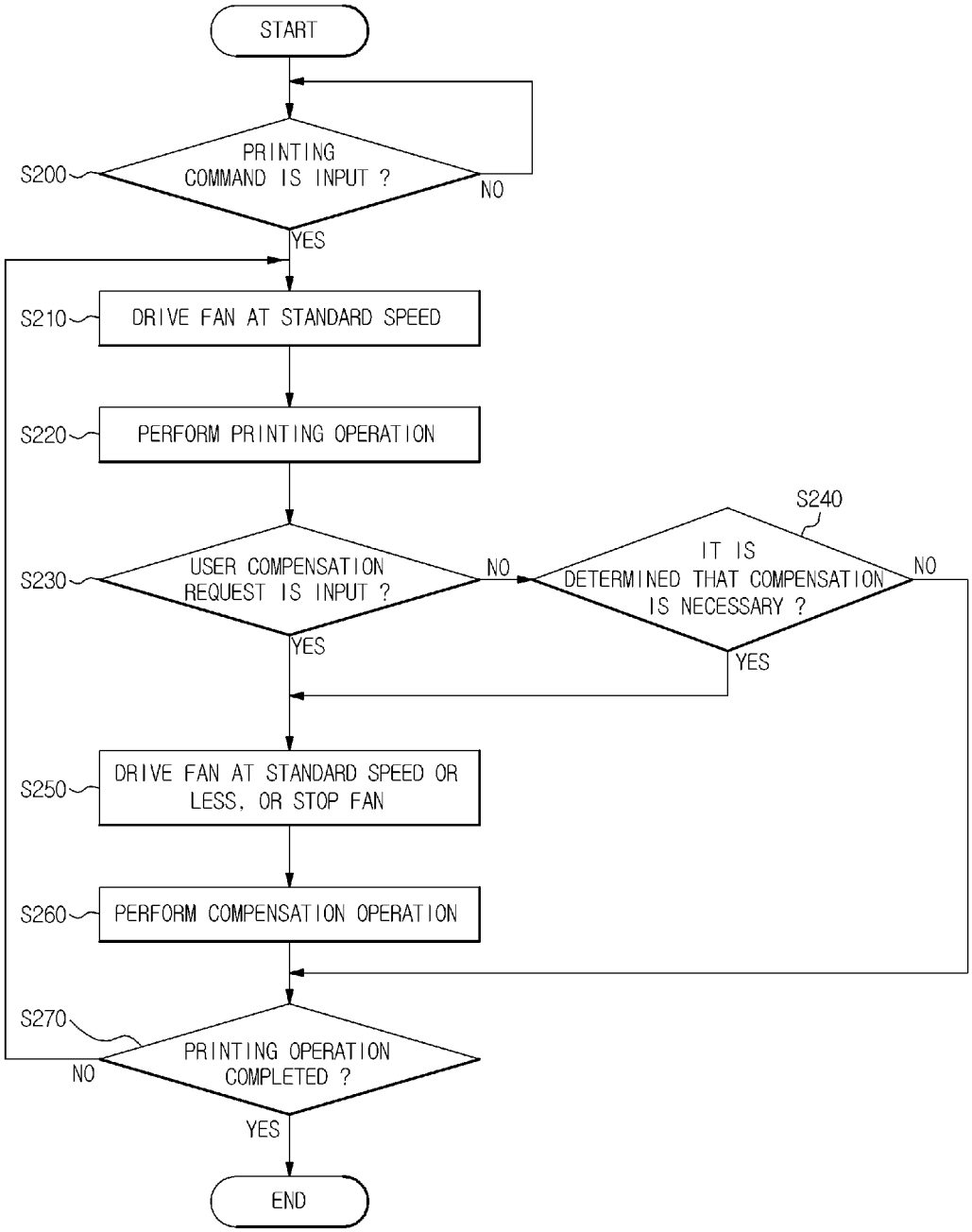
FIG. 9 is a control block diagram of an image forming apparatus according to an exemplary embodiment of the present general inventive concept.

FIG. 9 is a control block diagram of an image forming apparatus 1 according to an exemplary embodiment of the present general inventive concept.

As illustrated in FIG. 9, the controller 240 confirms, with reference to the input unit 200 or the memory 230, whether or not a printing command is input into the image forming apparatus 1 (S200).

Next, if it is confirmed that the printing command is input, the controller 240 drives the fans 180' and 180" at a standard speed while performing a printing operation (S210 and S220).

Next, the controller 240 confirms whether or not the user compensation request is input into the image forming apparatus 1 via the input unit 200. The compensation, for example, may be compensation of color tone density or auto color registration. However, the present general inventive concept is not limited thereto.

Next, if it is confirmed that the user compensation request is input, the controller 240 drives the fans 180' and 180" at a standard speed or less, or stops the fans 180' and 180". Specifically, the fans 180' and 180" are driven at a standard speed or less when the interior temperature of the image forming apparatus is larger than the predetermined temperature, or are stopped when the interior temperature of the image forming apparatus 1 is less than the predetermined temperature (S250).

Next, the controller 240 performs a compensation operation requested by the user, e.g., compensation of color tone density or auto color registration. Even if the image forming apparatus 1 is performing a printing operation, the image forming apparatus 1 may temporarily stop the printing operation to initiate the compensation operation in response to a user compensation command (S260).

Next, the controller 240 confirms whether or not the printing operation is completed after the compensation operation requested by the user is completed. If the printing operation is not completed, the controller 240 returns to the operation S210 (S270).

If it is confirmed in the operation S230 that the user compensation request is not input, the condition confirmation unit 210 confirms whether or not compensation of the image forming apparatus 1 is necessary. The image forming apparatus 1 is designed to periodically or non-periodically perform a compensation operation. In an exemplary embodiment, the image forming apparatus 1 may perform a compensation operation per a predetermined interval, or whenever images are formed on a predetermined number of printing media (S240).

Next, if it is confirmed that the image forming apparatus 1 requires a compensation operation, the controller 240 drives the fans 180' and 180" at a standard speed or less, or stops the fans 180' and 180". Specifically, the fans 180' and 180" are driven at a standard speed or less when it is confirmed that the interior temperature of the image forming apparatus is larger than the predetermined temperature, or are stopped when it is confirmed that the interior temperature of the image forming apparatus is less than the predetermined temperature (S250).

Next, the controller 240 performs a necessary compensation operation of the image forming apparatus 1 and then, determines whether or not the printing operation is completed and returns to the operation S210 if it is determined that the printing operation is not completed (S260 and S270).

Although compensation operations of the image forming apparatus 1 are illustrated in the above-described control flow charts of FIGS. 8 and 9, of course, the above description is equally applicable to other operations that are performed for a time period except for when the image is formed, such as, e.g., an operation to periodically form the developer strip to serve as a lubricant at the cleaning unit 140 to extend a lifespan or an anti-flip function of the cleaning unit 140.

As is apparent from the above description, according to the above-described exemplary embodiments of the present general inventive concept, fans, which serve to produce an air stream within an image forming apparatus, are driven at a speed lower than a standard speed, or are stopped for a time period corresponding to operations other than the image forming operation. This may minimize or prevent scattering of waste developer within the image forming apparatus.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include read-only memory (ROM), random-access memory (RAM), CD-ROMs, DVDs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Although several exemplary embodiments of the present general inventive concept have been illustrated and described, it would be appreciated by those skilled in the art that various changes may be made in these exemplary embodiments without departing from the principles and spirit of the general inventive concept, the scope of which is defined in the claims and their equivalents.

What is claimed is:

1. An image forming apparatus, comprising:

a fan to generate an air flow within the image forming apparatus; and a controller to drive the fan at a first speed corresponding to a first time period representing an image forming operation, and to drive the fan at a second speed corresponding to a second time period including times representing an operation other than the image forming operation and a time to perform compensation of color tone density of the image forming apparatus.

2. The image forming apparatus of claim 1, further comprising a temperature sensor to measure an interior temperature of the image forming apparatus, wherein the controller drives the fan at the second speed or stops the fan based on the interior temperature of the image forming apparatus.

3. The image forming apparatus of claim 2, wherein the controller drives the fan at the second speed when the interior temperature of the image forming apparatus is larger than a predetermined temperature.

4. The image forming apparatus of claim 2, wherein the controller stops the fan when the interior temperature of the image forming apparatus is less than a predetermined temperature.

5. The image forming apparatus of claim 1, wherein the controller drives the fan at a second speed lower than the first speed or stops the fan by controlling a voltage or a current supplied to the fan.

* * * * *